US007484569B2

(12) United States Patent
Kettner

(10) Patent No.: US 7,484,569 B2
(45) Date of Patent: Feb. 3, 2009

(54) PULSE TOOL

(75) Inventor: Konrad Karl Kettner, Aalen (DE)

(73) Assignee: Cooper Power Tools GmbH & Co., Westhausen (DE)

( * ) Notice: Subject to any disclaimer, the term of this patent is extended or adjusted under 35 U.S.C. 154(b) by 0 days.

(21) Appl. No.: 11/939,334

(22) Filed: Nov. 13, 2007

(65) Prior Publication Data

US 2008/0110655 A1 May 15, 2008

(30) Foreign Application Priority Data

Nov. 13, 2006 (EP) ..... 06023568

(51) Int. Cl.
*B25B 23/145* (2006.01)

(52) U.S. Cl. ..... 173/93.5; 173/176; 173/93

(58) Field of Classification Search ..... 173/93, 173/93.5, 93.6, 93.7, 104, 176
See application file for complete search history.

(56) References Cited

U.S. PATENT DOCUMENTS 2,727,598 A * 12/1955 Mitchell et al. ..... 173/178
3,477,521 A * 11/1969 Kiester et al. ..... 173/176
3,643,749 A * 2/1972 Pauley ..... 173/176
3,930,764 A * 1/1976 Curtiss ..... 418/43
4,359,107 A * 11/1982 Smith ..... 173/179
4,418,764 A * 12/1983 Mizobe ..... 173/177
4,444,272 A * 4/1984 Karden et al. ..... 173/179
5,092,410 A * 3/1992 Wallace et al. ..... 173/93.5
5,492,185 A * 2/1996 Schoeps et al. ..... 173/177
5,544,710 A * 8/1996 Groshans et al. ..... 173/176
5,573,074 A * 11/1996 Thames et al. ..... 173/178
5,775,439 A * 7/1998 Biek ..... 173/1
6,179,063 B1 * 1/2001 Borries et al. ..... 173/93.5
6,334,494 B1 * 1/2002 Nagato ..... 173/93.5
6,863,134 B2 * 3/2005 Seith et al. ..... 173/1
6,883,617 B2 * 4/2005 Putney et al. ..... 173/1
2003/0226674 A1 12/2003 Putney et al.

FOREIGN PATENT DOCUMENTS

DE 91177166 U1 8/1996
GB 772382 A 4/1957

* cited by examiner

*Primary Examiner*—Scott A. Smith
(74) *Attorney, Agent, or Firm*—King & Spalding LLP

(57) ABSTRACT

A pulse tool, in particular a pulse nutsetter, has at least one pneumatic drive unit with a drive rotor and a pulse unit driven by the drive unit, wherein a delay-dependent inertial cut-off device is assigned to the drive unit for the interruption of the air feed on acquiring a cut-off pules. A pulse tool of this nature is improved to the effect that it has or facilitates a compact design, a low weight and simultaneously, a fast cut-off by the inertial cut-off device. This is achieved by the inertial cut-off device having at least one cut-off piston for changing the air feed between the open and closed positions and which can be moved relative to the drive rotor and an, essentially annular, inertial body which can turn with the drive rotor. Due to the inertial body, on acquiring the cut-off pulse at least one drive body, essentially radially adjustable relative to the drive rotor, can be deflected due to an internal contour. The drive body is movably linked to a release device provided for the cut-off piston and which can be moved between a release position and a retaining position. The release device can be moved by the drive body into the release position for the release of the cut-off piston for movement into its closed position.

34 Claims, 3 Drawing Sheets

PULSE TOOL

FIELD OF THE INVENTION

The invention relates to a pulse tool, in particular a pulse nutsetter, with at least one pneumatic drive unit, which has a drive rotor and a pulse unit driven by said drive unit, wherein the drive unit, for the interruption of the air feed on receiving a cut-off pulse, is assigned a delay-dependent inertial cut-off device.

BACKGROUND OF THE INVENTION

A pulse tool of this nature is known from practice and is used, for example, for screwed joints. With a screwed joint of this nature it has been found to be advantageous if the screwed joint is tightened to a defined tightening torque. A corresponding cut-off pulse, produced by the pulse unit, is assigned to the tightening torque. With the application of this cut-off pulse the inertial cut-off device acquires a corresponding delay and causes an interruption of the air feed to the pneumatic drive unit, so that the drive unit ceases to drive the pulse unit and accordingly no further pulses are produced.

The object of the invention is to improve a pulse tool of this nature such that it has or facilitates a compact design, low weight and simultaneously a fast cut-off by the inertial cut-off device.

SUMMARY

This object is solved by the features of patent Claim 1.

According to the invention the inertial cut-off device has at least one cut-off piston for changing the air feed between the open and closed positions and which can be moved relative to the drive rotor and an, in particular annular, inertial body which can turn with the drive rotor. The cut-off piston can be simply moved from the open into the closed position, wherein in the closed position the air feed to the drive unit is completely or at least for the largest part interrupted. The inertial body is also appropriately rotated by the drive rotor. Once a pulse is set, further rotation of the inertial body optionally occurs relative to the drive body due to the corresponding inertia of the inertial body.

The inertial body has an inner contour through which at least one drive body, essentially radially adjustable relative to the drive rotor, can be deflected. The deflection of the drive body occurs accordingly on acquiring the cut-off pulse and the further rotation of the inertial body relative to the drive body. The said drive body is movably linked to a release device, provided for the cut-off piston and which can be moved between a release and a retaining position. Depending on the radial adjustment of the drive body, the release device is appropriately arranged in the region between the release and retaining positions. In the release position, release of the cut-off piston occurs so that it can be moved from its open to the closed position.

According to the invention only a few parts are required for the inertial cut-off device, which are preferably of low mass and only travel slight distances in order in particular to facilitate an appropriate adjustment of the cut-off piston into its closed position. A simple arrangement of the cut-off piston relative to the drive unit can be provided when the cut-off piston is movably mounted on an essentially cylindrical rotor extension of the drive rotor opposite the pulse unit. In this way the corresponding adjustment of the cut-off piston occurs between the closed and open positions directly along the rotor extension.

The tool can be designed more compact if the inertial body extends around the rotor extension and in particular is mounted for rotation on its free end.

An inertial body, which is simple to manufacture and which also takes up relatively little space, is an inertial body with essentially a circular external circumference and a polygonal internal circumference with corresponding inner contour. Due to the polygonal internal circumference or the internal contour a deflection of the drive body occurs with relative movement between the rotor extension and the inertial body.

The internal contour or internal circumference can be formed differently. Preferably an essentially triangular and in particular equilateral internal circumference can be considered.

In order to be able to move the drive body well guided along the appropriate sides of the triangle up to the corresponding apices of the triangle, the appropriate sides of the triangle can have a convex curvature.

In order to be able to reliably arrange the drive body in the sides of the triangle during the common rotation of the inertial body and the rotor extension, the corresponding apices of the triangle can have convex inner sides. In this case this convex curvature can correspond to the curvature of the drive body.

In order to be able to load the appropriate bearing body better and more uniformly by the drive bodies, a drive body can be assigned to each apex of the triangle. In this way three drive bodies of spherical shape are on acquiring the cut-off pulse appropriately moved in the direction of the bearing body and adjust it for the release of the cut-off piston.

Generally, an appropriate pulse tool can be moved in both directions of rotation both for fastening and also for releasing a screwed joint. In order to dispense with an automatic cut-off by the inertial cut-off device when releasing the screwed joint, the polygonal internal circumference can be asymmetrical relative to the axis of rotation defined by the rotor extension. Drive balls are preferably used as drive bodies, because they do not require any specific assignment to the corresponding apices of the triangle.

In order to ensure in a simple manner that the inertial body rotates with the rotor extension when it rotates, it can have a carrier device for the drive bodies for their deflection radially outwards. That is, with the rotation of the rotor extension the drive bodies move into the apices of the triangle due to the carrier device and in this way carry the inertial body with them so that the inertial body rotates appropriate to the rotor extension or to the rotor of the drive unit.

A simple implementation of a carrier device of this nature can be conceived that has at least radial openings and a bearing body arranged in a longitudinal hole of the radial extension. The drive bodies are mounted radially adjustably in the radial openings and are prevented from falling into the corresponding longitudinal hole of the rotor extension by the bearing body.

In order to obtain good contact between the bearing body and the drive body the bearing body can be formed spherically or conically at least in the direction of the drive body.

It can be considered particularly preferable if the bearing body is part of the release device and is mounted adjustably in the longitudinal direction of the longitudinal hole. That is, that with radial adjustment of the drive bodies inwards on acquiring the cut-off pulse, the drive bodies press on the bearing body to adjust it in the longitudinal direction of the longitudinal hole, and so it facilitates as part of the release device adjustment of the cut-off piston from its open into its closed position. In order in this connection to press the bearing body in a simple manner against the drive bodies in particular before acquiring the cut-off pulse, pressure can be applied to the bearing body in the direction of the drive body.

There is also the possibility that pressure is applied to the cut-off piston in the direction of the closed position in particular by means of a piston compression spring. In this way there is the advantage that on the release of the cut-off piston it is pressed directly into the closed position by its piston compression spring, and in particular no carriage of the cut-off piston by for example the bearing body or other parts of the release device needs to take place.

In order to keep the cut-off piston securely in its open position before its release, the rotor extension can have at least one elongated hole on the circumference in which in each case a locking body is movably mounted, with which the cut-off piston is in contact from one end and a retaining sleeve of the release device, movably mounted in the longitudinal hole, is in contact from the other end. This retaining sleeve can be moved in the longitudinal direction of the longitudinal hole by moving the bearing body, wherein the locking body can move along the elongated hole and accordingly the cut-off piston moves from the open into the closed position.

In order to securely retail the cut-off piston in particular in the open position by the locking body, the cut-off piston can have an accommodating groove for the locking body in its inner side.

The seating of the retaining sleeve on the locking body can for example take place such that the locking body is in contact with a free end of the retaining sleeve. If the retaining sleeve is then moved in the longitudinal direction of the longitudinal hole, the locking body follows the free end along the elongated hole and correspondingly the cut-off piston with its accommodating groove for the locking body, so that it can be moved accordingly for the movement of the retaining sleeve from its open to its closed position.

In order to load the retaining sleeve in a simple manner opposing a corresponding adjustment by the bearing body, pressure can be applied to the retaining sleeve within the longitudinal hole in the direction of the locking body, in particular by a compression spring.

In order to prevent the locking body in a simple manner from falling into the longitudinal hole of the rotor extension, cut-off sleeve can be arranged within the retaining sleeve and can be in contact with the bearing body with one contacting end. The cut-off sleeve and the retaining sleeve are joined for movement so that with an adjustment of the cut-off sleeve by the bearing body adjustment of the retaining sleeve occurs simultaneously. The application of pressure to the retaining sleeve can simultaneously be used for the application of pressure to the cut-off sleeve correspondingly in the direction of the bearing body.

In particular, in this connection the locking body can be in contact with an outer side of the retaining sleeve, by means of which the locking body is prevented from falling into the longitudinal hole.

Furthermore, it can be considered favourable if a threaded stud is arranged within the cut-off sleeve, the first end of which facing the drive unit has pressure applied to it in the direction of the bearing body.

With a threaded stud of this nature the cut-off pulse in particular can be adjusted in that for example the threaded stud is adjustable in the longitudinal hole for the variation of the pressure applied to it.

An advantageous embodiment can be conceived in that the threaded stud is directly screwed to the cut-off sleeve for the adjustment relative to it. In this case the cut-off sleeve is in contact with the bearing body, as described above, and through the connection to the threaded stud and the possibility of the variation of the pressure applied to it, a variation of the pressure applied to the bearing body by the cut-off sleeve arises correspondingly.

A simple possibility of applying pressure to the threaded stud can be seen when a corresponding stud compression spring with an optional collar stud is arranged between it and the first end of the threaded stud. The stud compression spring can for example be arranged between a closed end of the longitudinal hole of the rotor or of the rotor extension and the threaded stud or the collar stud.

In order to keep the cut-off piston in its open position in the idle state, a spring constant of the compression spring can be greater than a spring constant of the piston compression spring. In this way no release of the cut-off piston occurs due to the release device without the inertial cut-off device.

In order to facilitate adequate sealing of the air feed in the direction of the drive unit, the cut-off piston can have a closing flange protruding radially outwards. In the closed position it then contacts the appropriate air channels or similar features within the pulse tool to seal them.

With the previously described construction, in particular of the inertial cut-off device, it has also been found to be advantageous if the inertial body is mounted floating. This means that essentially the inertial body during its rotation is supported and also driven by drive bodies pressed radially outwards by the set force of the stud compression spring on the bearing body and rotated by the carrier device together with the rotor extension.

Further bearings for the inertial body are not necessary.

In this connection it can also be advantageous if optionally the drive bodies are secured at the side in the longitudinal direction by limit stops such as for example snap rings or similar components.

In order to facilitate easy adjustment of the threaded stud and thus easy adjustment of the cut-off pulse without having to remove a large number of parts of the pulse tool, the bearing body can have an essentially central longitudinal opening which is aligned to an insertion recess in the threaded stud. Then rotation of the threaded stud can take place through this longitudinal opening via the insertion recess and thus adjustment in the longitudinal direction can occur, by means of which the application of pressure by the stud compression spring can be varied.

In order also in this connection not have to remove any part of the housing of the pulse tool, the housing of the pulse tool can have an insertion opening for an adjustment tool, which can be inserted through it and then through the longitudinal opening of the bearing body into the insertion recess for rotating the threaded stud.

The appropriate insertion opening of the housing must generally be able to be closed, so that within the housing the appropriate air feed can occur with adequate pressure. A simple method of closing the insertion opening can be conceived when it has on its inner side a sealing seat for the sealing contact of in particular a spherical closing body. This closing body can be for example a rubber ball. The closing body is removed from its sealing seat by the appropriate adjusting tool and then the adjusting tool is inserted through into the insertion recesses in the housing. After adjustment of the threaded stud and removal of the adjusting tool, the closing body is again automatically pressed into sealing contact with its sealing seat during the establishment of the air pressure within the housing.

To prevent an automatic rotation of the threaded stud relative to the cut-off sleeve a frictionally engaged element in the form of, for example, a spring, an elastomer pin or similar component can be arranged between them. Furthermore, the cut-off sleeve can be secured against rotation via a spherical locking body relative to the rotor extension to take up the reaction on rotating the threaded stud.

BRIEF DESCRIPTION OF THE DRAWINGS

In the following, an advantageous embodiment of the invention is explained in more detail based on figures enclosed in the drawing.

The following are shown.

DETAILED DESCRIPTION OF THE EXEMPLARY EMBODIMENTS

Figure 1:
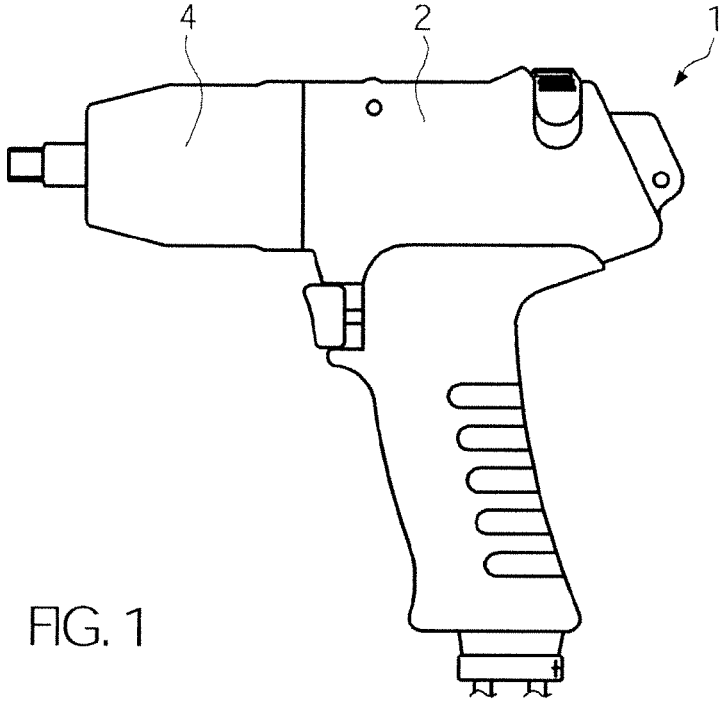
FIG. 1 a side schematic illustration of a pulse tool according to the invention.

FIG. 1 illustrates a side view of a pulse tool 1 with a handle and a release knob as well as a pneumatic drive unit 2 in the form of an air-driven motor and a pulse unit 4. The pulse unit 4 can be formed in a manner known per se as a single, dual or multi-chamber impact unit. The drive unit 2 also has a reverse button 54 assigned to it, through which the direction of rotation of the drive unit 2 can be changed.

Figure 2:
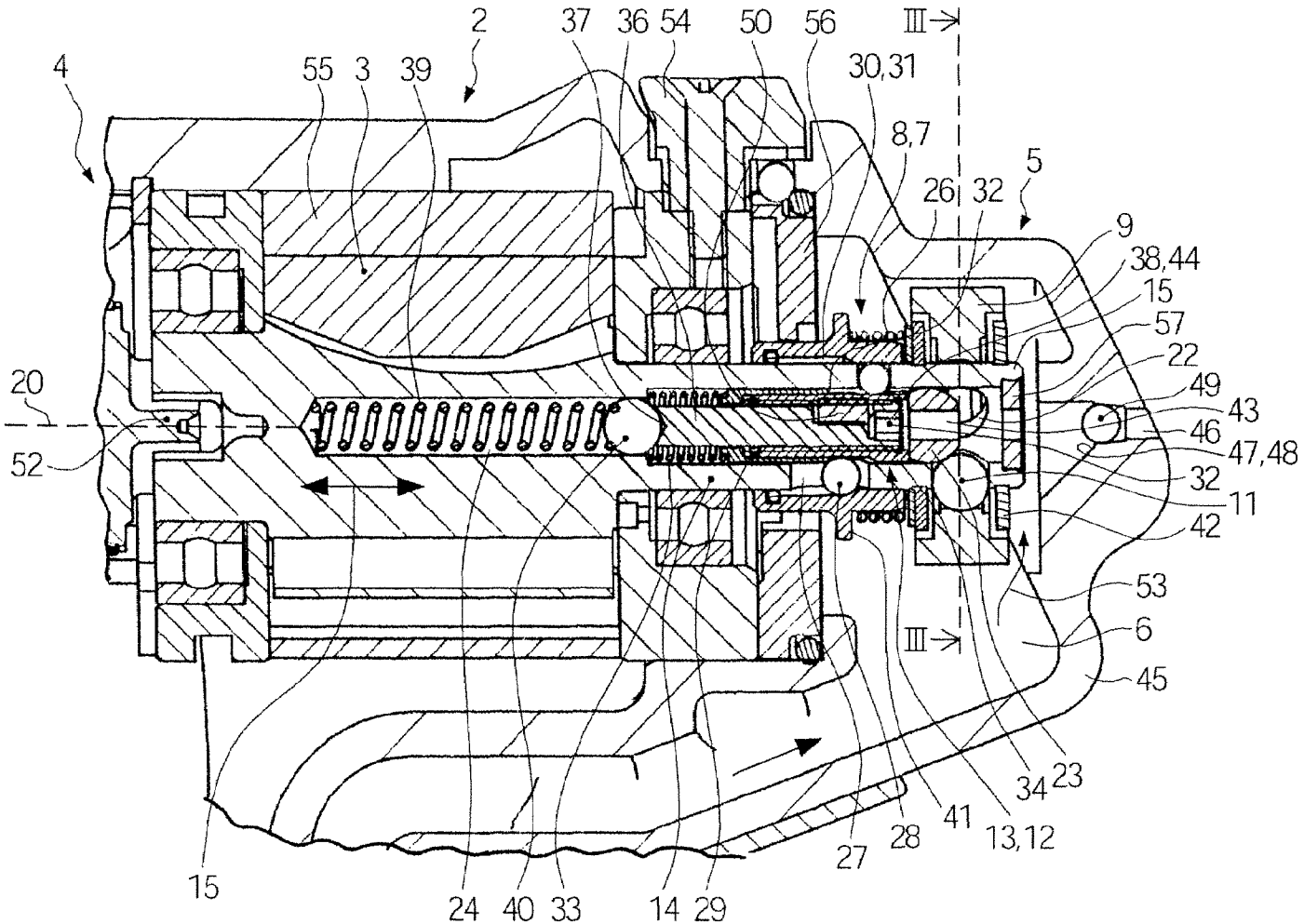
FIG. 2 a longitudinal section through a drive unit with inertial cut-off device for a pulse tool according to FIG. 1.
Figure 4:
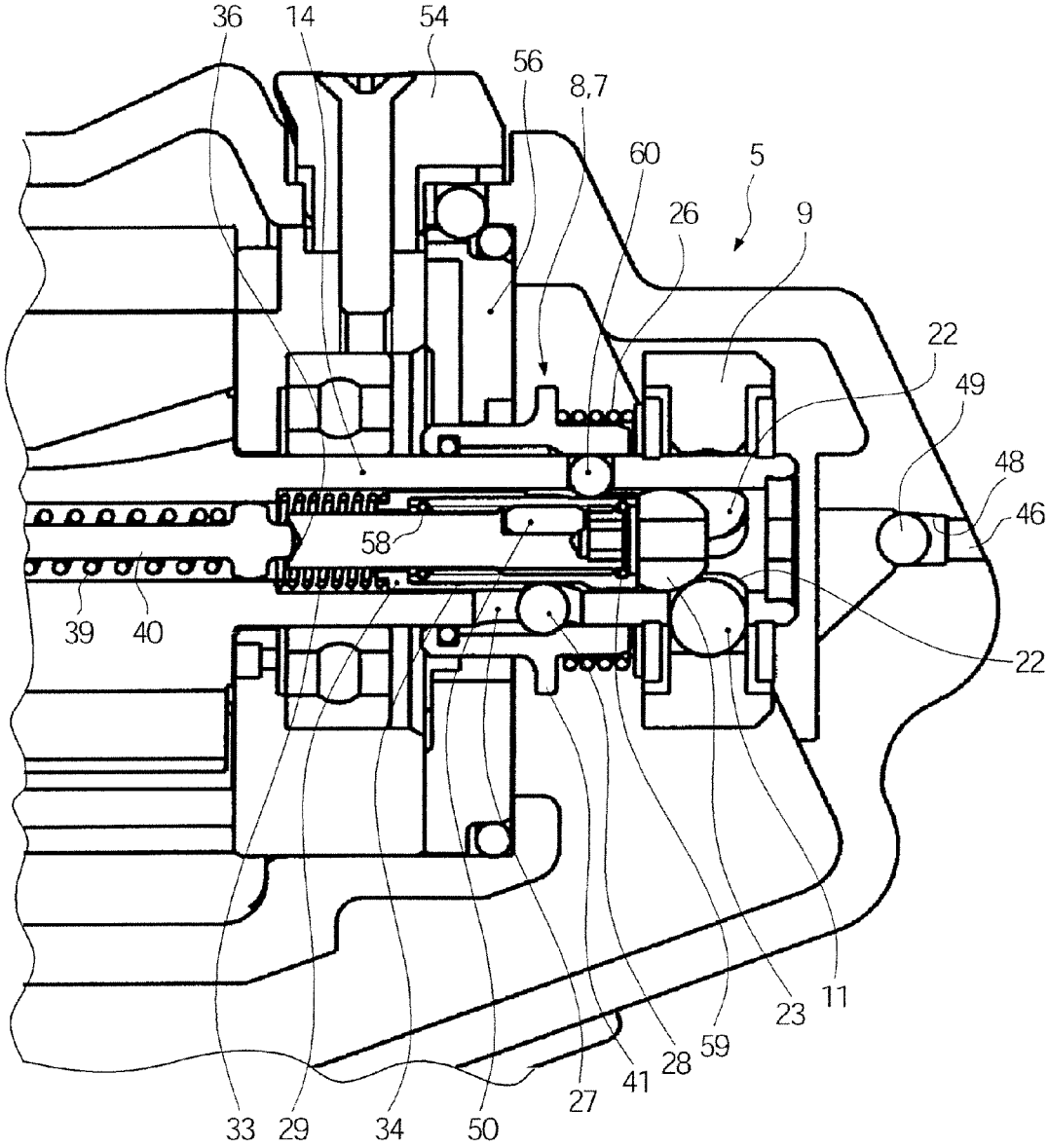

In FIG. 2—refer also to FIG. 4—a longitudinal section in particular through the drive unit 2 and an assigned delay-dependent inertial cut-off device 5 are shown.

The drive unit 2 comprises at least one drive rotor 3, which can be rotated by corresponding air pressure within a motor cylinder 55. Air pressure is made available via an air feed 6, wherein with actuation of the corresponding release button on the handle, refer also to FIG. 1, the air feed takes place in the direction of flow 53.

The rotor 3 is connected at its end facing the pulse unit 4 to a rotor extension 52 of the impact mechanism so that in this way the pulse unit 4 is driven by the drive unit 2.

The corresponding drive rotor 3 has opposite the pulse unit 4 a cylindrical rotor extension 14. This and also in part the drive rotor 3 have centrally a longitudinal hole 24 in the longitudinal direction 25. Both the drive rotor 3 and also the rotor extension 14 are mounted for rotation relative to the motor cylinder 55 or the housing 45 of the pulse tool 1 via appropriate pivot bearings.

Within the longitudinal hole 24 some elements of the inertial cut-off device 5 are arranged. A stud compression spring 39 is used to apply pressure to a collar stud (FIG. 4) or a pressure ball 40 (FIG. 2) within the longitudinal hole 24. This collar stud 40 is arranged between the stud compression spring 39 and a threaded stud 36. A first end 37 of the threaded stud 36 is formed as an essentially conical centring and accommodation feature for the collar stud 40. The threaded stud 36 extends up to its second end 38 which is assigned via a cut-off sleeve 34 to a bearing body 23. This bearing body 23 has a spherical or optionally also a conical outer surface. Centrally in the bearing body 23 a longitudinal opening 43 is arranged, which is aligned with an insertion recess 44 on the second end 38 of the threaded stud 36. The insertion recess 44 has a hexagonal cross-section and is used for the access of an adjusting tool which can be introduced from outside of the pulse tool 1, as will be explained in the following.

The threaded stud 36 is arranged in a cut-off sleeve 34 and can be adjusted relative to it, wherein generally a thread is formed between the two components. To secure a certain relative rotary position between the threaded stud 36 and the cut-off sleeve 34, a frictionally engaged element 50 in the form of an elastomer pin, a spring or similar component is provided. To secure the cut-off sleeve against rotation also at least one locking body 60 according to FIG. 2 is provided with the rotor extension for taking up the reaction when rotating the threaded stud 36.

The cut-off sleeve 34 contacts the bearing body 23 with its free contacting end 35, wherein a corresponding contact between the threaded stud 36 and the bearing body 23 is only present when the threaded stud 36 is appropriately screwed out of the cut-off sleeve 34, wherein the axial end positions of the threaded stud 36 are limited by locking rings 58, 59 according to FIG. 2 on both ends of the internal thread of the cut-off sleeve 34.

Thus, contact between the contacting end 35 of the cut-off sleeve 34 and the bearing body 23 occurs exclusively.

The cut-off sleeve 34 is at least partially inserted into a retaining sleeve 29, which similarly extends in the longitudinal direction 25 and within the longitudinal hole 24. The retaining sleeve 29 is in contact with its free end 32 with at least one locking body 28 in a spherical shape. At its other end pressure is applied to it by a compression spring 33 in the direction of the bearing body 23. This compression spring 33 is supported within the longitudinal hole 24 by a step and is supported approx. at the height of the collar stud 40.

In the region of the spherical locking body 28 the rotor extension 14 has at least one elongated hole 27, along which the locking body 28 can be moved depending on the displacement of the retaining sleeve 29 in the direction of the collar stud 40. Simultaneously, the locking body 28 contacts an outer side of the cut-off sleeve 34, so that the locking body 28 is prevented from falling into the longitudinal hole 24.

In the region of the locking body 28 or elongated hole 27 a cut-off piston 8 is arranged, which is mounted for movement outside on the rotor extension 14 in the longitudinal direction 25. This cut-off piston 8 has approx. centrally a closing flange 41 which protrudes radically outwards and which on moving the cut-off piston 8 in the direction of the drive unit 2 contacts an air distribution plate 56 for interrupting the air feed to the drive unit 2. On its inner side 30 the cut-off piston 8 has an accommodating groove 31 in which the locking body 28 is partially accommodated opposite the cut-off sleeve 34.

Outside on the cut-off piston 8 a piston compression spring 26 is arranged for applying a pressure to the cut-off piston 8 in the direction of the drive unit 2. This has a spring constant which is lower than the corresponding spring constant of the compression spring 33.

The bearing body 23 is pretensioned appropriately for the pressure application through in particular the contacting end 35 of the cut-off sleeve 34 and its connection to the threaded stud 36 as well as the pressure applied to it by the stud compression spring 39 in the direction of the bearing body 49. Its spherical or conical outer side is contacted by one, two, three or more spherical drive bodies 11. In addition these are supported by the outer surfaces of the bearing body 23 in radial openings 22 of the rotor extension 14.

Through the bearing body 23 and the radial opening 22 a carrier device 21 for these drive bodies 11 is formed so that the drive bodies 11 are carried along with rotation of the drive rotor 3 and according to the rotor extension 14. These protrude at least partially out of the radial openings 22 and contact an internal contour 10 or an internal circumference 17 of an inertial body 9 of the inertial cut-off device 5. In the illustrated embodiment three drive bodies 11 are used, refer also to FIG. 3.

The inertial body 9 extends in an annular manner outside around he rotor extension 14 and is supported floating by the drive bodies 11 at the free end 15 of the rotor extension. At the side the drive bodies 11 are secured by limit stops 42 for example in the form of snap rings or similar components. At the side the drive bodies are similarly secured by the radial openings 22 of the rotor extension.

One end of the rotor extension 14 is closed off by a closing plate 57, which has a central opening.

Figure 3:
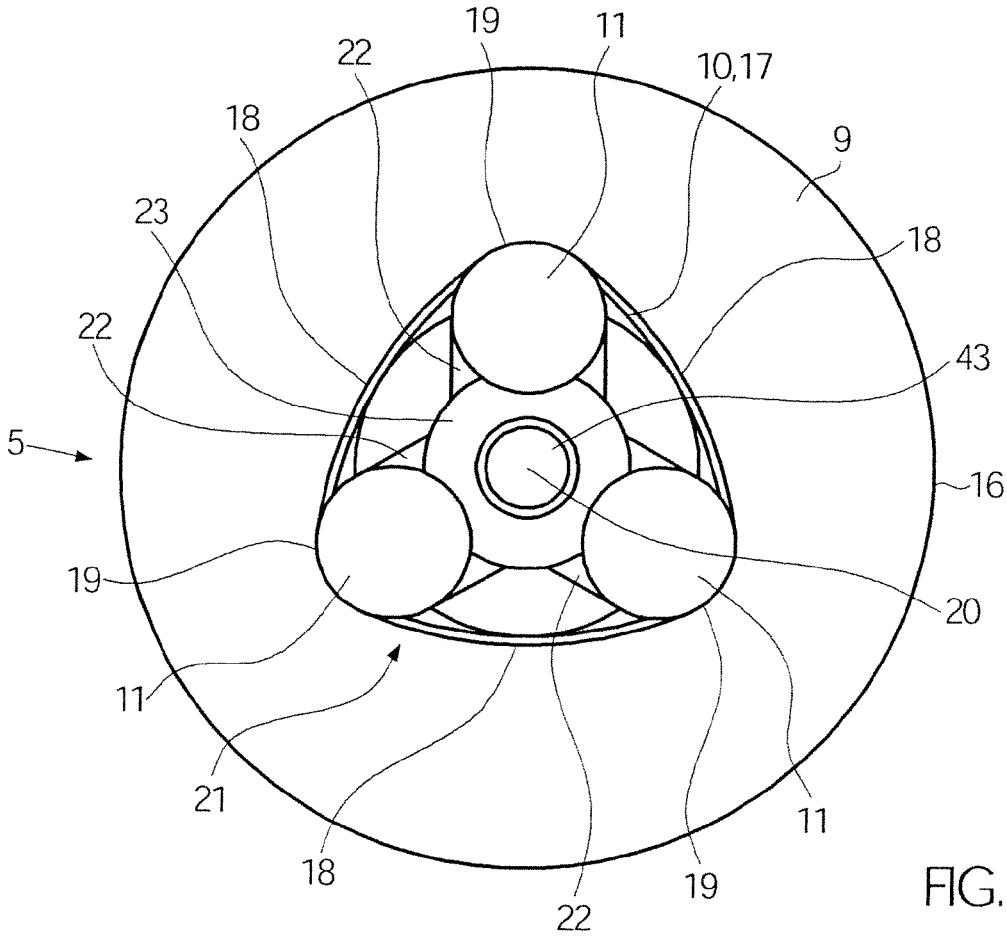
FIG. 3 a section along the line III-III in FIG. 2 through the inertial cut-off device, and FIG. 4 an enlarged illustration of part of FIG. 2.

In FIG. 3 a section along the line III-III from FIG. 2 is essentially illustrated only by the inertial cut-off device 5. This has an annular inertial body 9 and spherical drive bodies 11 arranged in it. An external circumference 16 of the inertial body 9 is circular in shape and the internal circumference 17 or internal contour 10 are polygonal. In the illustrated embodiment the internal contour 10 is formed triangular and in particular equilateral. The corresponding sides of the triangle 18 have a slightly convex curvature, as also the corresponding apices of the triangle 19, wherein their curvature essentially corresponds to an appropriate external curvature on the drive bodies 11.

In particular it can be seen from FIG. 3 that the drive bodies 11 are supported for radial adjustment in the radial openings 22 of the rotor extension 14. The bearing body 23 with its spherical or conical outer surface is arranged between the drive bodies 11. The longitudinal opening 43 is arranged centrally in the bearing body 23. This is aligned with the corresponding insertion recess 44 or insertion opening 46 in the housing 45, refer also to FIG. 2. On the inner side of the insertion opening 46 of the housing 45 a sealing seat 48 for a closing body 49 is formed, which for example is formed by a rubber ball or similar component.

In FIG. 3 the drive bodies 11 are arranged in the apices of the triangle 19 and contact the corresponding internal contour 10. This arrangement is obtained with rotation of the drive unit 2 and thus with the corresponding mutual rotation of the inertial body 9 with the rotor extension 14. The internal contour 10 as in FIG. 3 is rotationally symmetrical with regard to the axis of rotation 20. There is also the possibility that the internal contour 10 is formed appropriately asymmetrically in order, for example, not to use the inertial cut-off device 5 with reverse rotation of the drive unit 2.

If the transfer of the cut-off pulse occurs, which corresponds to an appropriate final torque for tightening a screwed joint, further rotation of the inertial body 9 takes place relative to the rotor extension 14. This further rotation leads to a movement of the drive bodies 11 radially inwards in the direction of the axis of rotation 20. This occurs through the corresponding internal contour 10 of the inertial body 9. In doing this, the drive bodies 11 press on the spherical or conical surface of the bearing body 23. This is moved by applying pressure in FIG. 2 towards the left in the direction of the drive unit 2. With this movement, the movement occurs appropriately via the cut-off sleeve 34 similarly in the same direction, as also the retaining sleeve 29, which is movably connected to the cut-off sleeve 34. Together with the cut-off sleeve 34, the threaded stud 36 moves correspondingly against the pressure applied by the stud compression spring 39. The appropriate cut-off pulse has beforehand been set using an adjustment tool and insertion opening 46, longitudinal opening 43 and insertion recess 44 through appropriate rotation of the threaded stud 36 relative to the cut-off sleeve 34 and the thus changed pressure applied by the stud compression spring 39.

With the adjustment of the retaining sleeve 29 against the pressure applied by the compression spring 33, an adjustment of the locking body 28 in the elongated hole 27 can also be made. Corresponding to this adjustment, a displacement of the cut-off piston 8 occurs due to the pressure applied by the piston compression spring 26. With adequate adjustment of the cut-off piston 8, at least a reduction of the air feed occurs until optionally the corresponding closing flange 21 contacts the air distribution plate 56. In FIG. 2 the release device formed from the retaining sleeve, cut-off sleeve and threaded stud is arranged in its retaining position 12.

In this so-called closed position of the cut-off piston 8 no rotation of the drive unit 2 occurs and thus also no rotation of the pulse unit 4. As long as the release button in the handle, refer to FIG. 1, is pressed by a worker, the corresponding air pressure is however still applied. It is only when the worker stops pressing the release button that no further application of compressed air occurs and the return of the cut-off piston 8 and the retaining sleeve follows in particular due to the larger spring constant of the compression spring 39 in comparison to the piston compression spring 26.

A corresponding return of the cut-off sleeve 34 and of the bearing body 23, by means of which the drive bodies 11 are correspondingly moved into the apices of the triangle 19, refer to FIG. 3, always occurs immediately after release of the inertial body by the stud compression spring 39. This means that first the return of the inertial body generally occurs into its initial position and then the return of the retaining sleeve 29, cut-off piston 8 and piston compression spring 26 by means of locking balls 9, when the worker releases the release button.

With regard to the cut-off piston 8 it should be noted that in the open position 7 as in FIG. 2 or 4 it is pressure-neutral and so no movement can be carried out into the closed position. This occurs only when correspondingly the inertial cut-off device 5 is actuated, as described above. Furthermore, it should also be noted that the adjustment of the cut-off piston 8 by the inertial cut-off device 5 in the closed position need occur only partially with a corresponding release by the release device 13, wherein for example a displacement of 80 to 95% in the direction of the closed position can be sufficient. The final shut-off of the drive unit 2 can then occur due to the arising pressure differences on the cut-off piston.

The invention claimed is:

1. A pulse tool (1), in particular a pulse nutsetter, comprising: at least one pneumatic drive unit (2), having a drive rotor (3), and a pulse unit (4) driven by the drive unit, wherein the drive unit (2) is assigned a deceleration-dependent inertial cut-off device (5) for the interruption of an air feed on reaching a cut-off pulse wherein the inertial cut-off device (5) has at least one cut-off piston (8), which is movable between an open and a closed position (7) relative to the drive rotor (3) for changing the air feed; and a substantially annular inertial body (9) rotatable by the drive rotor (3) and upon reaching the cut-off pulse at least one drive body (11), is adjustable radially relative to the drive rotor (3) and is deflected by means of an internal contour (10) of the inertial body (9), said drive body being movably connected to a release device (13) movable between a release and a retaining position (12), for the cut-off piston (8), wherein the release device (13) is movable by the drive body (11) into the release position for the release of the cut-off piston (8) for movement into its closed position.

2. The pulse tool according to claim 1, further comprising movably supporting the cut-off piston (8) on an essentially cylindrical rotor extension (14) of the drive rotor (3) opposite the pulse unit (4).

3. The pulse tool according to claim 2, wherein the inertial body (9) extends around the rotor extension (14) and is supported for rotation at a free end (15) of the rotor extension.

4. The pulse tool according to claim 2, wherein the rotor extension (14) comprises a carrier device (21) for the drive body (11) for its deflection radially outwards.

5. The pulse tool according to claim 4, wherein the carrier device (21) comprises radial openings (22) in the rotor extension (14) and a bearing body (23) arranged in a longitudinal hole (24) of the rotor extension.

6. The pulse tool according to claim 5, wherein the bearing body (23) is formed spherically or conically at least in the direction of the drive body (11).

7. The pulse tool according to claim 5, wherein the bearing body (23) is part of the release device (13) and is supported for adjustment in the longitudinal direction (25) of the longitudinal hole (24).

8. The pulse tool according to claim 5, where pressure is applied to the bearing body (23) in the direction of the drive body (11).

9. The pulse tool according to claim 5, further comprising a cut-off sleeve (34) arranged at least partially within the retaining sleeve (29) and in contact with a contacting end (35) of the bearing body (23).

10. The pulse tool according to claim 9, wherein the locking body (28) contacts an outer side of the cut-off sleeve (34).

11. The pulse tool according to claim 10, further comprising a threaded stud (36) arranged within the cut-off sleeve (34), wherein pressure is applied to the first end (37) of the threaded stud facing the drive unit (2) in the direction of the bearing body (23).

12. The pulse tool according to claim 11, wherein the pressure applied to the first end (37) is varied by adjusting the threaded stud (36) in the longitudinal hole (24).

13. The pulse tool according to claim 12, wherein the threaded stud (36) is screwed to the cut-off sleeve (34) for adjustment relative to the cut-off sleeve.

14. The pulse tool according to claim 12, further comprising a stud compression spring (39) with optionally a collar stud (40) arranged between it and the first end (37) of the threaded stud (36), wherein the spring applies pressure to the threaded stud.

15. The pulse tool according to 12, wherein the bearing body (23) has an essentially central longitudinal opening (43) in alignment with an insertion recess (44) in the threaded stud (36).

16. The pulse tool according to claim 15, further comprising a housing (45) of the pulse tool (1) comprising an insertion opening (46) for an adjusting tool, the adjusting tool configured to be inserted through the insertion opening and through the longitudinal opening into the insertion recess (44) for rotating the threaded stud (36).

17. The pulse tool according to claim 16, where the insertion opening (46) comprises a sealing seat (48) on its inner side (47) for the sealing contact of an, in particular spherical, closing body (49).

18. The pulse tool according to claim 12, further comprising a frictionally engaged rotational securing element (50) arranged between the threaded stud (36) and the cut-off sleeve (34).

19. The pulse tool according to claim 2, wherein the rotor extension comprises at least one elongated hole (27), in which a locking body (28) is movably supported, with which the cut-off piston (8) from a first side and from a second side a retaining sleeve (29) movably supported in the longitudinal hole (24) are in contact.

20. The pulse tool according to claim 19, wherein the cut-off piston (8) comprises an accommodating groove (31) for the locking body (28) on an inner side (3).

21. The pulse tool according to claim 20, wherein pressure is applied to the retaining sleeve (29) within the longitudinal hole (24) in the direction of the locking body (28), in particular by a compression spring (33).

22. The pulse tool according to claim 21, wherein a spring constant of the compression spring (33) is greater than a spring constant of the piston compression spring (36).

23. The pulse tool according to claim 19, wherein the locking body (28) contacts a free end (32) of the retaining sleeve (29).

24. The pulse tool according to claim 2, wherein the cut-off piston (8) comprises a closing flange (41) protruding radially outwards.

25. The pulse tool according to claim 1, wherein the inertial body (9) comprises an essentially circular external circumference (16) and a polygonal internal circumference (17).

26. The pulse tool according to claim 25, wherein the internal circumference (17) is essentially formed in the shape of an equilateral triangle.

27. The pulse tool according to claim 26, wherein each side of the triangle is convex.

28. The pulse tool according to claim 26, wherein the apices of the triangle (19) of the internal circumference (17) have convex inner sides.

29. The pulse tool according to claim 26, further comprising assigning a drive body (11) to each apex of the triangle (19).

30. The pulse tool according to claim 25, wherein the polygonal internal circumference (17) is asymmetrical relative to an axis of rotation (20) which is the rotor extension (14).

31. The pulse tool according to claim 1, wherein the drive body (11) is a drive ball.

32. The pulse tool according to claim 1, wherein pressure is applied to the cut-off piston (8) in the direction of the closed position, in particular by means of a piston compression spring (26).

33. The pulse tool according to claim 1, wherein the inertial body (9) is floatingly supported.

34. The pulse tool according to claim 1, wherein the drive bodies (11) are additionally secured at the side in the longitudinal direction (25) by limit stops (22), such as for example snap rings or similar components.

* * * * *